US011021891B2

(12) United States Patent
Lowrey

(10) Patent No.: US 11,021,891 B2
(45) Date of Patent: Jun. 1, 2021

(54) TOOL FOR BARBED WIRE

(71) Applicant: WIREMAN PTY LIMITED, Milsons Point (AU)

(72) Inventor: Ian Lowrey, Surry Hills (AU)

(73) Assignee: WIREMAN PTY LIMITED

( * ) Notice: Subject to any disclaimer, the term of this patent is extended or adjusted under 35 U.S.C. 154(b) by 0 days.

(21) Appl. No.: 16/644,848

(22) PCT Filed: Sep. 6, 2018

(86) PCT No.: PCT/AU2018/050965

§ 371 (c)(1),
(2) Date: Mar. 5, 2020

(87) PCT Pub. No.: WO2019/060946

PCT Pub. Date: Apr. 4, 2019

(65) Prior Publication Data

US 2020/0386008 A1 Dec. 10, 2020

(30) Foreign Application Priority Data

Sep. 28, 2017 (AU) ..... 2017903937
Jul. 11, 2018 (AU) ..... 2018902509

(51) Int. Cl.
*E04H 17/26* (2006.01)
*B21F 25/00* (2006.01)
*E04H 17/04* (2006.01)

(52) U.S. Cl.
CPC ..... *E04H 17/268* (2013.01); *B21F 25/00* (2013.01); *E04H 17/04* (2013.01)

(58) Field of Classification Search
CPC ..... E04H 17/04; E04H 17/268; B21F 25/00; B25B 25/00
See application file for complete search history.

(56) References Cited

U.S. PATENT DOCUMENTS 179,625 A 7/1876 Swan
183,379 A 10/1876 Dobbs
207,405 A 8/1878 Eberhart
207,449 A 8/1878 Sellers
(Continued)

FOREIGN PATENT DOCUMENTS

EP 0060959 A1 * 9/1982 ..... E04H 17/268

OTHER PUBLICATIONS

Australian Patent Office, The International Search Report and The Written Opinion of the International Searching Authority, Oct. 15, 2018, for International Application No. PCT/AU2018/050965.

*Primary Examiner* — Jonathan P Masinick
(74) *Attorney, Agent, or Firm* — Design IP

(57) ABSTRACT

A tool (1) for loosening or removing a set (2) of barbs (3) from barbed wire (4) is disclosed. The barbed wire has at least one strand (7) of wire and a plurality of spaced apart sets of barbs wound around the wire. The barbs extend in substantially opposite directions from a wire helix (6) wound around the wire. The tool has first and second portions (11) each engageable with the wire and having an opposed levering element (8) that is radially offset from the wire for applying leverage to the helix. Rotation of the portions in a first direction abuts each of the levering elements against a corresponding one of the pair of barbs to unwind or unfurl the helix.

20 Claims, 7 Drawing Sheets

(56) References Cited

U.S. PATENT DOCUMENTS

| | | | | | |
|---|---|---|---|---|---|
| 319,982 | A | * | 6/1885 | Lasar | B21F 25/00<br>140/59 |
| 1,294,677 | A | * | 2/1919 | Klenk | E04H 17/04<br>256/7 |
| 2,330,611 | A | * | 9/1943 | Nelson | B21F 25/00<br>140/65 |
| 2,959,399 | A | * | 11/1960 | Dupont | E04H 17/04<br>256/7 |
| 2,973,185 | A | * | 2/1961 | Brixner | E04H 17/04<br>256/6 |

* cited by examiner

Fig 4.
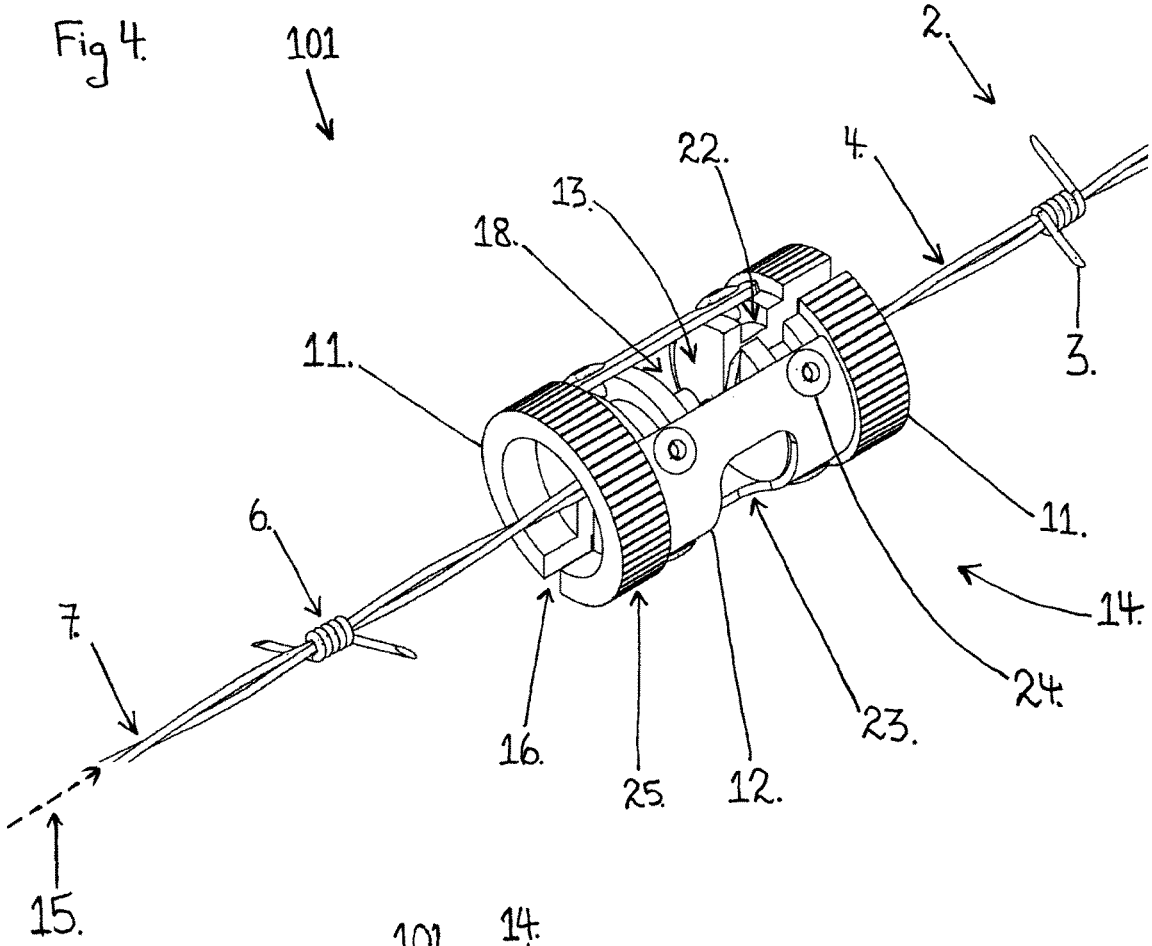
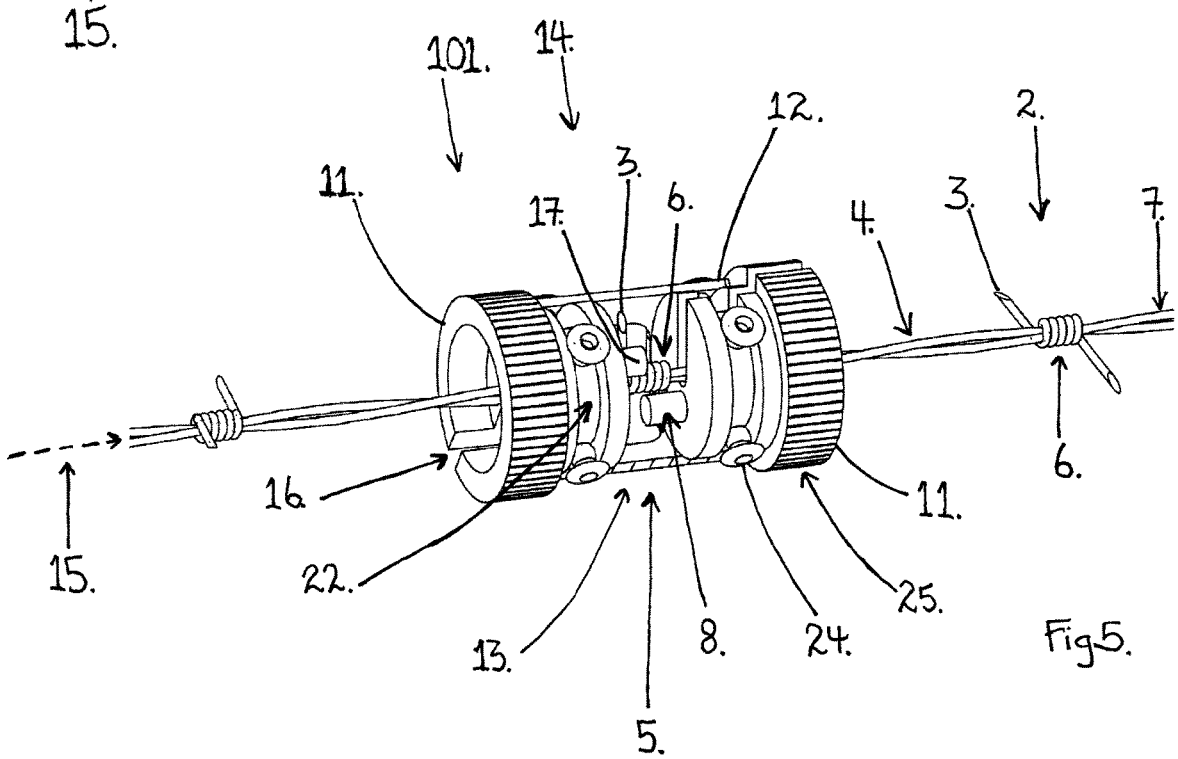
Fig 5.

TOOL FOR BARBED WIRE

FIELD OF THE INVENTION

The present invention relates to barbed wire, in particular to means for loosening or removing a set of barbs from barbed wire.

BACKGROUND ART

Barbed wire is used to discourage animals or people from passing through or over a fence line. The barbs can be formed by a variety of methods. Most commonly, a pair of barbs is formed by twisting a short length of wire about the main strand and leaving the two ends of the twist jutting in opposite directions. A set of four barbs can be formed by co-locating two twists and leaving each of the four ends jutting in different directions. Barbed wire is commonly made from one main strand, or two main strands twisted about each other. Two-strand wire is preferred for preventing the barbs from rotating about, or sliding along, the main wire when contacted by an animal. When formed around two strands, the twists have an asymmetrical cross-section, thereby resisting rotation, and the twisted main strands also resist sliding of the barbs.

A variant on the above called traditional twist barbed wire is made by a process wherein the short lengths of wire forming the barbs are first inserted between the two main strands before being twisted there around. The sets of barbs on traditional twist barbed wire have an even greater resistance to movement.

One problem with barbed wire is the difficulty in handling and tying off the ends, for example to a post or to another wire. To avoid interference from the sets of barbs, wire tensioners are usually rigged with normal, un-barbed, fencing wire which is then attached to the barbed wire. Furthermore, repairs to breaks in the barbed wire are often required.

Another problem with barbed wire arises with steel fence posts which have notches, rather than through holes, to retain wire. Each notch is provided with a pivotal clip. The installation procedure is to run the barbed wire alongside the fence posts and then tension the barbed wire. Then the tensioned barbed wire is engaged with the same notch on each post by raising the clip, inserting the wire into the notch, and lowering the clip to thereby permanently interconnect the wire and post. However, for some posts the location of a set of barbs will be exactly opposite the notch with which the barbed wire is intended to be engaged. Under these circumstances it is necessary to remove this particular set of barbs in order to enable the wire to be engaged with the intended notch. This problem particularly arises with so-called exclusion fencing.

The sets of barbs interfere with these activities and it is common to first remove them with a pair of pliers or side cutters. However, removal can be a cumbersome process with hand tools, and especially when working with a free end that is not under tension. Also, the use of hand tools such as side cutters can risk inadvertently nicking, kinking, or otherwise damaging the main strands which is relevant since the wire will be re-installed under high tension.

Genesis of the Invention

The genesis of the present invention is a desire to provide a tool for loosening or removing a set of barbs from barbed wire that overcomes or at least ameliorates some of the deficiencies of the prior art.

SUMMARY OF THE INVENTION

In accordance with a first aspect of the present invention there is disclosed a tool for loosening or removing a set of barbs from barbed wire, said barbed wire comprising at least one strand of wire and a plurality of spaced apart sets of barbs wound thereon, said strand(s) constituting a wire axis, each of said sets of barbs comprising at least one pair of barbs extending in substantially opposite directions from a wire helix wound around said strand(s); said tool having first and second portions each engageable with said barbed wire, each of said portions having an opposed levering element that is radially offset from said axis for applying leverage to said helix, wherein with said first and second portions engaged with said barbed wire: said first and second portions are rotatable relative to each other about said wire axis, and, whereby said relative portion rotation in a first direction abuts each of said levering elements against a corresponding one of said pair of barbs to unwind or unfurl said helix.

BRIEF DESCRIPTION OF THE DRAWINGS

Some embodiments of the invention will now be described, by way of example only, with reference to the accompanying drawings in which:

FIG. 4 is a perspective view of the barb removal tool of a second embodiment when engaged with a length of barbed wire, FIG. 5 is a partial longitudinal section of the barb removal tool of FIG. 4 illustrating the unwinding mechanism set against a pair of barbs within the central region of the tool.

DETAILED DESCRIPTION

Figure 1:
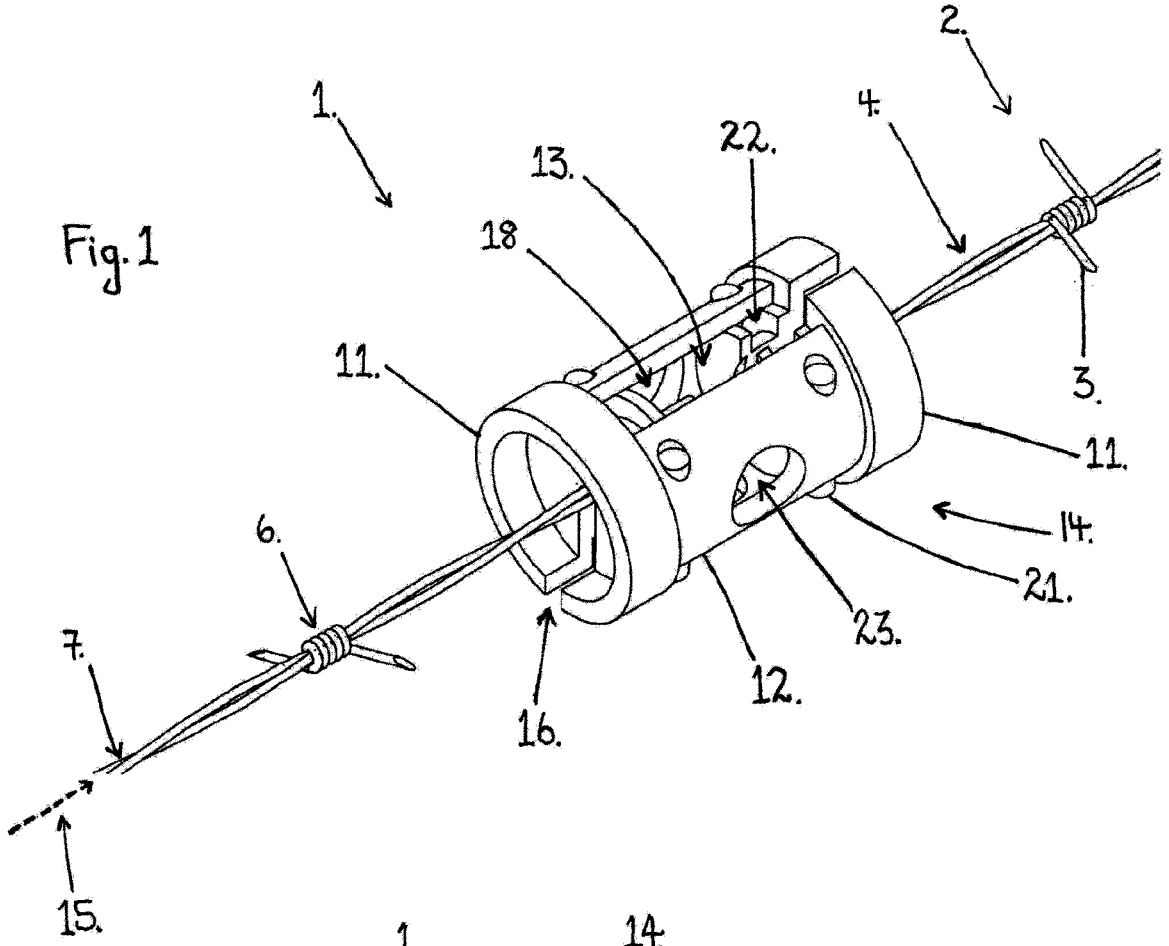
FIG. 1 is a perspective view of the barb removal tool of a first embodiment when engaged with a length of barbed wire.
Figure 2:
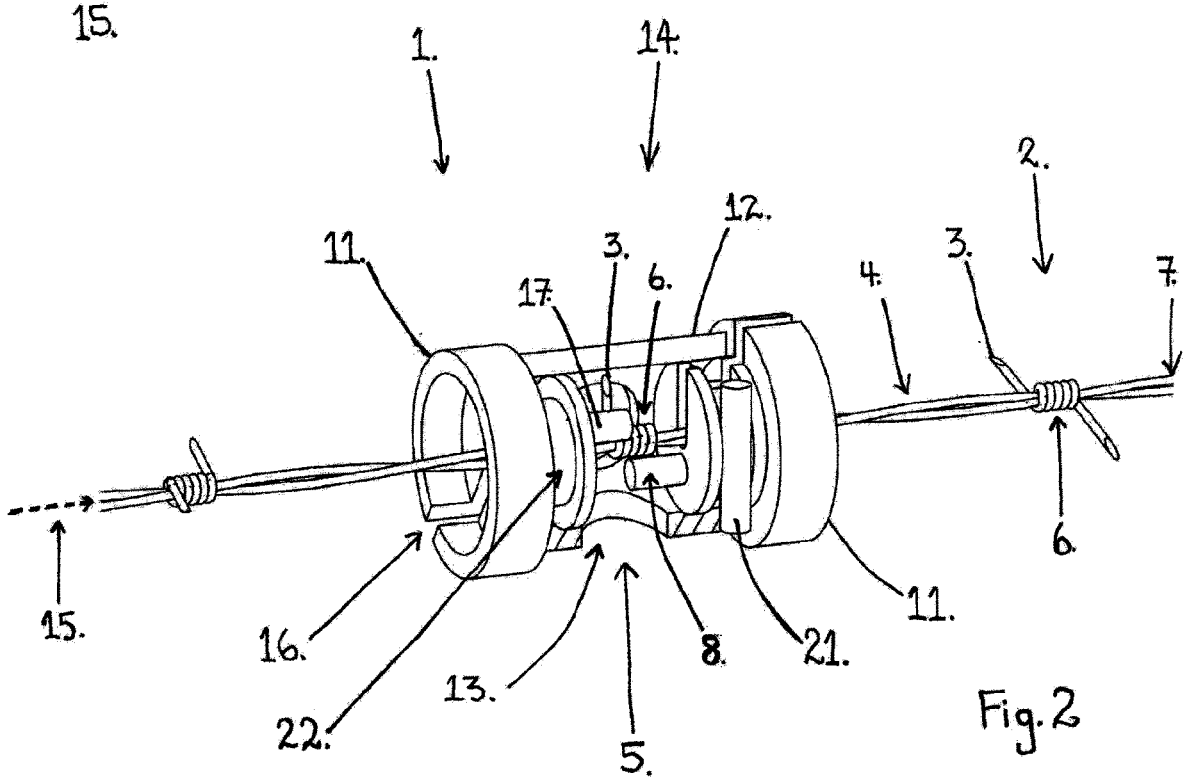
FIG. 2 is a partial longitudinal section of the barb removal tool of FIG. 1 illustrating the unwinding mechanism set against a pair of barbs within the central region of the tool.

According to a first embodiment there is provided a tool 1 for loosening or removing a set 2 of barbs 3 from barbed wire 4.

The tool 1 is provided with a mechanism 5 for unwinding or unfurling a helical twist 6 of wire from the main strand or strands 7. The mechanism 5 includes two opposing levering elements 8 that can engage with, and apply leverage to, opposite ends of the helix 6. By applying leverages that oppose the handedness of the twist 6, the twist 6 can be unwound or unfurled from the main strands 7 at least sufficiently to allow for its removal. For example, a twist 6 of enlarged diameter can be removed by sliding it off an adjacent free end of the barbed wire 4.

The body 14 of the tool 1 includes two end portions 11 separated by a hollow cylindrical spacer 12 that surrounds a central region 13. The body 14 is configured to internally accommodate the main strand(s) 7 along their axis 15, and also to accommodate a set 2 of barbs 3 (and the twist 6 therebetween) within the central region 13 where the unwinding mechanism 5 is housed. The tool 1 has an overall shape which is substantially co-axial about the wire axis 15.

Each of the two end portions 11 has a radially extending slot or aperture 16 for receiving the barbed wire 4 into the body 14 of the tool 1. Each end portion 11 also supports a corresponding levering element 8, and is counter-rotatable relative to the other end portion 11 about the axis 15 of the barbed wire 14 when so received.

The levering elements 8 of the first embodiment are cylindrical prongs 17 that jut inwardly from the corresponding end portions 11 and extend substantially parallel to the wire axis 15 into the central region 13. The levering elements 8 are each configured to contact the corresponding barbs 3 at positions that are radially offset from the wire axis 15, so as to enable leverage against the twist 6.

The end portions 11 can thus engage with the barbed wire 4, be manipulated to set the unwinding mechanism 5 against the barbs 3, and then be relatively counter-rotated about the wire axis 15 to unwind or unfurl the twist 6.

The cylindrical spacer 12 of the first embodiment is adapted to ensure the smooth and effective operation of the tool 1. The spacer 12 axially constrains, and also maintains the alignment of, the end portions 11 and the unwinding mechanism 5 supported thereon. The spacer 12 also has a longitudinally extending slot or aperture 18 to enable the barbed wire 4 to enter into the body 14 of the tool 1.

Figure 3:
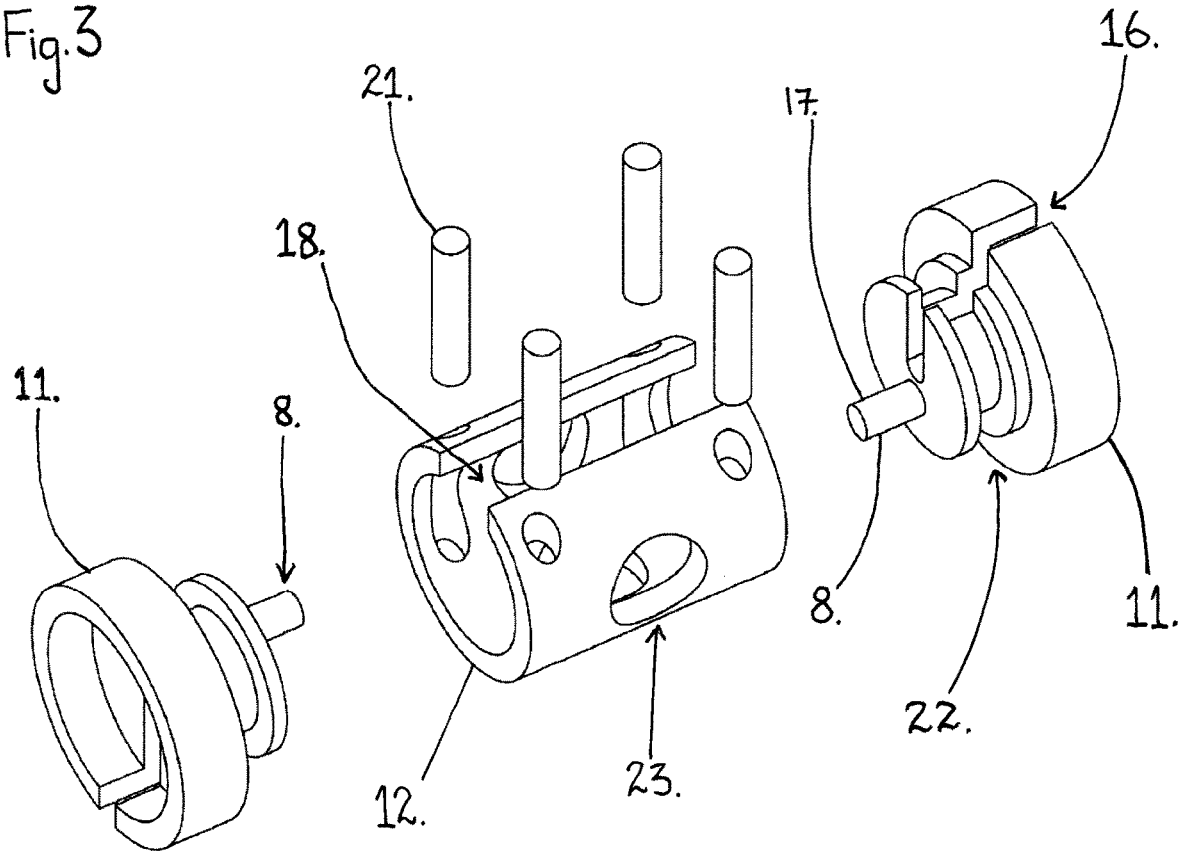
FIG. 3 is an exploded perspective view of the barb removal tool of FIGS. 1 and 2 illustrating the means for inter-connection of parts.

The inter-engagement between the end portions 11 and the spacer 12 of the first embodiment is achieved by means of a pin 21-and-groove 22 engagement. As seen in FIG. 3 the ends of the pins 21 are retained in the circular grooves 22 of the end portions 11.

In other embodiments, the spacer 12 engages with the end portion 11 by analogous means such as a snap fitting, an annular tongue-and-groove fitting, a or staple-and-groove fitting (or staple lock). Preferably the spacer 12 rotates relative to each of the end portions 11, however, it is also possible to have the spacer 12 fixed to one of the end portions 11.

The engagement of the spacer 12 with the end portions 11 is such that the levering elements 8 maintain their radial position about the axis 15 of the wire 4 when the unwinding mechanism 5 is operated by relative counter-rotation of the end portions 11.

The spacer 12 is provided with several windows 23. The windows 23 allow the unwound barb to drop out of the tool. The windows 23 also ensure operator visibility of the unwinding procedure, and accessibility of the central region 13 to hand tools, if required. The windows 23 can also allow for the event of a twist 6 tending to unwind in directions other than a circumferential expansion of the helix.

When the unwinding or unfurling is complete, the slots 16, 18 in the end portions 11 and spacer 12 can be re-aligned by relative rotation of the end portions 11 to allow the tool 1 to be released from the now de-barbed wire 4 by moving the wire 4 out of the slot 18.

It will be appreciated that the above tool 1 can also be used for sets 2 of barbs 3 made up from more than one pair of barbs 2, for example where multiple twists 6 of wire about the main strand(s) 7 are co-located to provide, typically, four barbs 3 that jut in mutually orthogonal directions.

In a second embodiment of the invention, the inter-engagement between the end portions 11 and the spacer 12 is achieved by means of a rivet 24-and-groove 22 engagement as illustrated in FIGS. 4 to 7.

The tool 101 of this second embodiment is also provided with a means of increasing friction with the user's hands, such as a plurality of indents, protrusions, knurling, or scorings 25 disposed about the circumference of each end portion 11, for ease of counter-rotation.

Figure 6:
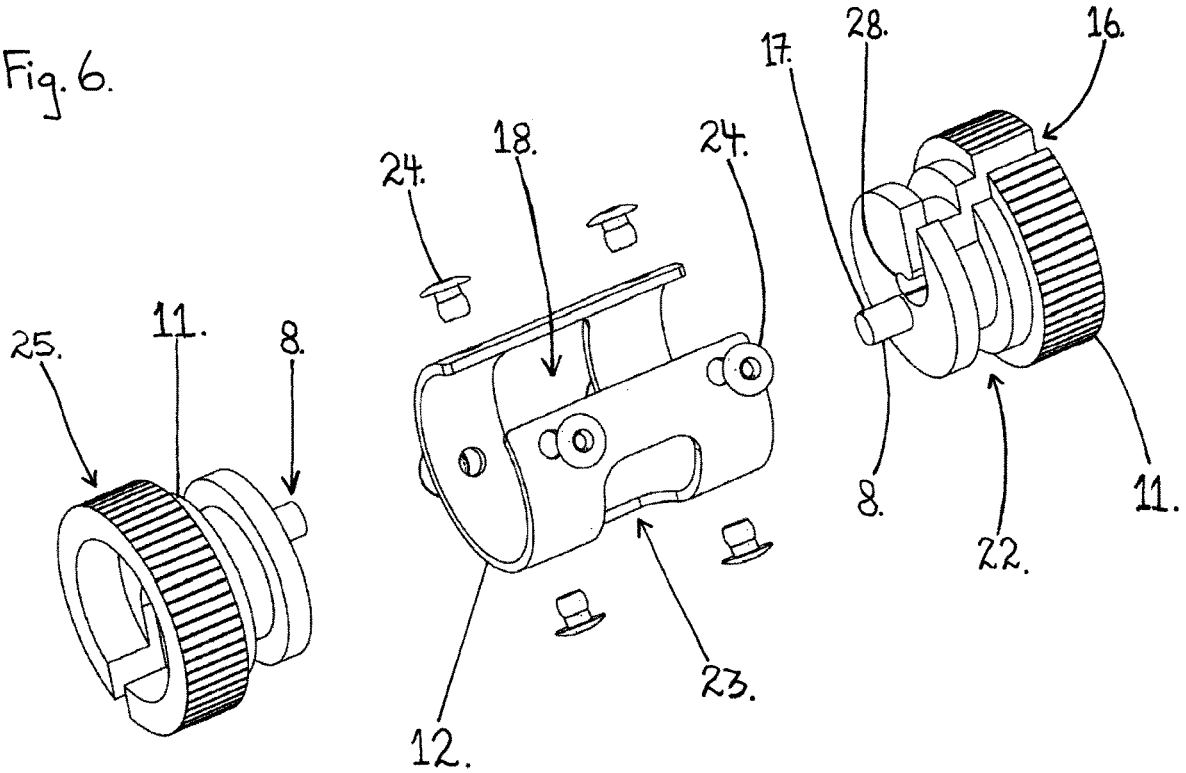
FIG. 6 is an exploded perspective view of the barb removal tool of FIGS. 4 and 5 illustrating the means for inter-connection of parts.

As illustrated in FIG. 6, the slot 16 in the end portion 11 of the tool 101 of the second embodiment is also provided with a curved, J-shaped, or hockey-stick shaped portion 28. This curved portion 28 permits both easy location of the wire 15 within its proper position in the tool 101 and maintenance of that position when the unwinding mechanism 5 is operated. The curved portions 28 of the tool 1 are preferably made with the same handedness such that the wire 14 engages with each curved portion 28 when the end portions 11 are counter-rotated. In other embodiments, the curved portions 28 on the tool 1 are made with opposite handedness.

Figure 8:
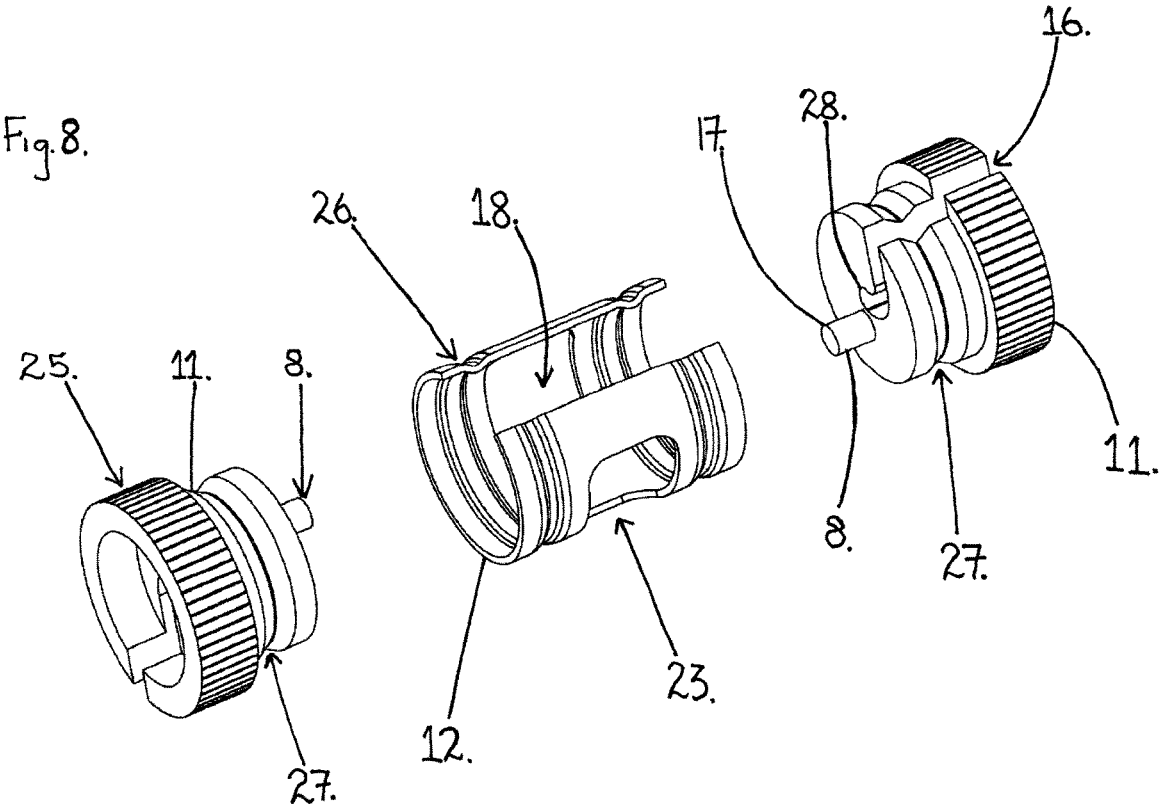
FIG. 8 is an exploded perspective view of the barb removal tool of a third embodiment illustrating the means for inter-connection of parts.
Figure 7:
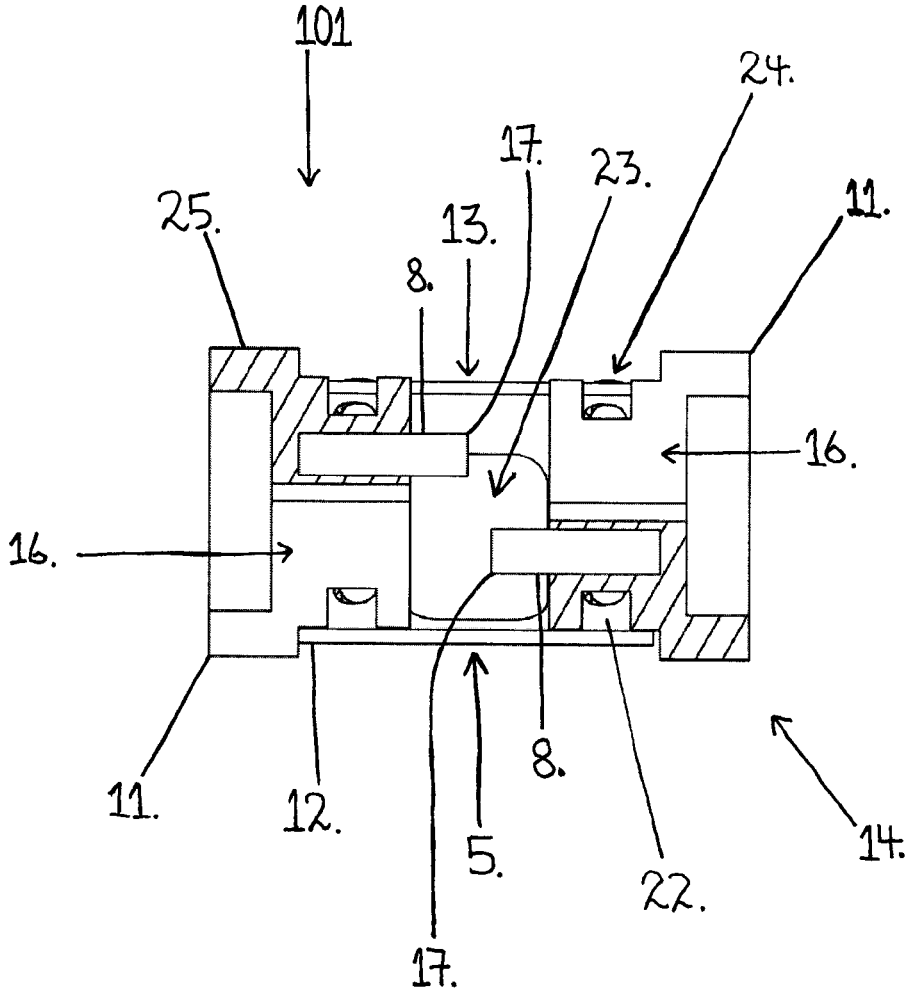
FIG. 7 is a longitudinal section of the barb removal tool of FIGS. 4 to 6 illustrating the configuration of the unwinding mechanism and the inter-connection of parts.

In a third embodiment of the invention as illustrated in FIG. 8, the inter-engagement between each of the end portions 11 and the spacer 12 is achieved by means of an annular rim or ridge 26 formed on the inside of the spacer 12 that engages with a valley or notch 27 formed on the corresponding end portion 11. The spacer 12 is made from mild steel and the spacer ridge 26 is cold-pressed with a roller.

Figure 9:
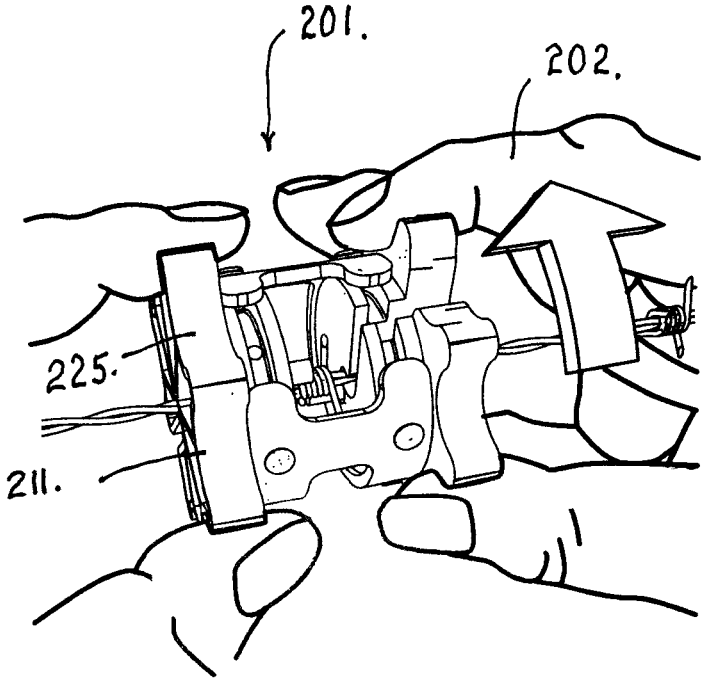
FIG. 9 is a perspective view of a still further embodiment illustrating scalloped end portions.
Figure 10:
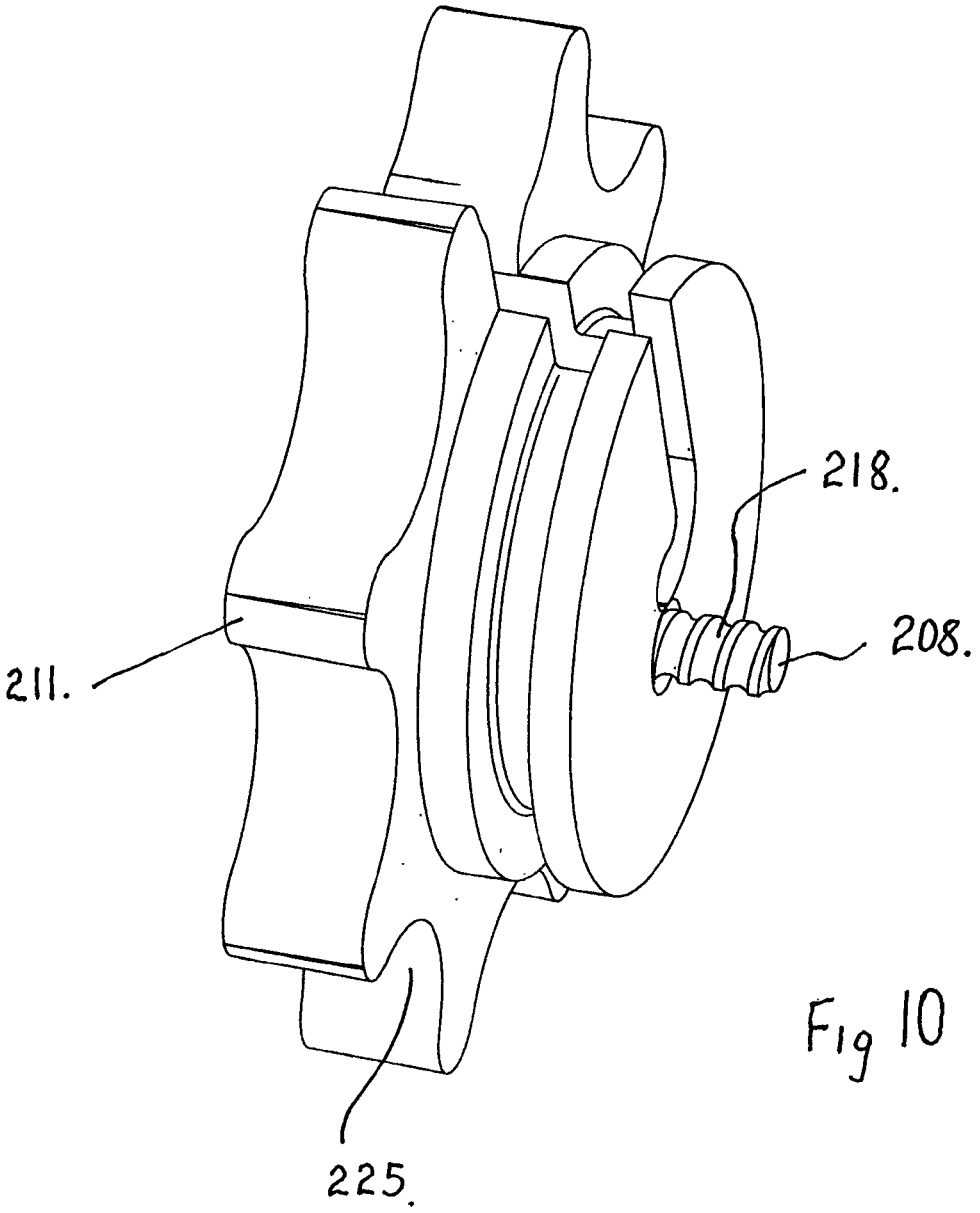
FIG. 10 is a perspective view of an end portion of the device of FIG. 9 having a modified levering element.

Turning now to FIGS. 9 and 10, a still further embodiment of the tool 201 is illustrated in which the end portions 211 are provided with scalloped protrusions 225 which enable the operator's fingers 202 to better engage with the end portions 211. This is particularly the case where the operator is wearing gloves, which normally reduce the operator's usual dexterity somewhat.

Illustrated in FIG. 10 is a substantially cylindrical levering element 208 which is provided with a helical rope thread 218. It will be apparent to those skilled in the art that the barbs 3 although notionally identical at the time of manufacture, are not necessarily identical at the time of utilising the tool 201. In particular, the barbs 3 may have been bent or otherwise mis-aligned during transportation or installation of the barbed wire, or during subsequent normal operation of the fence. The thread 218 is intended to engage with the corresponding barb 3 and the movement of the levering element 208 drives the barb 3 so as to be more perpendicular to the longitudinal axis of the element 208. In this way the inter-engagement between the element 208 and the barb 3 is enhanced and maintained. In particular, the barb 3 lies within the groove of the thread 218 and is driven towards the end portion 211 by the crest of the thread 218.

In other embodiments, the levering element 8, 208 can be provided with other modifications including a head, similar to the head of the nail, or a plurality of cylindrical ridges which are co-axial with the longitudinal axis of the levering element, or threads other than the above described and illustrated rope thread.

In other embodiments, each of the end portions 11 is provided with a means for easily selecting the proper alignment of the slots 16, 18 in the end portions 11 and spacer 12, such as a ball detent pin between each end portion 11 and the sleeve 12.

The foregoing describes only some embodiments of the present invention and modifications, obvious to those skilled in the fencing arts, can be made thereto without departing from the scope of the present invention.

The term "comprising" (and its grammatical variations) as used herein is used in the inclusive sense of "including" or "having" and not in the exclusive sense of "consisting only of".

The invention claimed is:

1. A tool for loosening or removing a set of barbs from barbed wire, said barbed wire comprising at least one strand of wire and a plurality of spaced apart sets of barbs wound thereon, said strand(s) constituting a wire axis, each of said sets of barbs comprising at least one pair of barbs extending in substantially opposite directions from a wire helix wound around said strand(s); said tool having first and second portions each engageable with said barbed wire, each of said portions having an opposed levering element that is radially offset from said axis for applying leverage to said helix, wherein with said first and second portions engaged with said barbed wire: said first and second portions are rotatable relative to each other about said wire axis, and, whereby said relative portion rotation in a first direction abuts each of said levering elements against a corresponding one of said pair of barbs to unwind or unfurl said helix.

2. The tool according to claim 1 wherein each of said levering elements comprises a prong that is radially offset from the axis and generally aligned with the axis.

3. The tool according to claim 1 wherein the first and second portions are each rotatable relative to the axis.

4. The tool according to claim 1 and further having a hollow spacer disposed between the first and second portions, whereby said portions are constrained by said spacer from moving toward each other or away from each other along the axis.

5. The tool according to claim 4 when dependent upon paragraph 3, wherein each of the first and second portions are rotatably engaged with the spacer.

6. The tool according to claim 4 wherein the spacer is engaged with at least one of the first and second portions by means of an annular tongue-and-groove or a snap fitting.

7. The tool according to claim 4 wherein the spacer is engaged with at least one of the first and second portions by means of a staple or pin.

8. The tool according to claim 4 wherein the spacer is engaged with at least one of the first and second portions by means of at least one rivet or protrusion projecting from the spacer into a groove formed in said portion.

9. The tool according to claim 4 wherein the spacer is engaged with at least one of the first and second portions by means of an annular rim or projection formed about an inside circumference of the spacer; said rim or projection engaging with a notch formed in said portion.

10. The tool according to any one of claim 4 wherein the first and second portions, and the spacer, when engaged with said barbed wire are substantially co-axial about the axis.

11. The tool according to any one of claim 1 wherein the spacer is provided with a longitudinal spacer slot that can be aligned substantially parallel to the axis for receiving and releasing the tool from the barbed wire.

12. The tool according to any one of claim 4 wherein the spacer is provided with at least one aperture or window.

13. The tool according to claim 4 wherein at least one of the first and second portions is provided with a ball detent that is engageable with the spacer.

14. The tool according to any one of claim 1 wherein at least one of the first and second portions is provided with a corresponding radial first and second slot that can be aligned substantially perpendicular to the axis for receiving and releasing the barbed wire from the tool.

15. The tool according to any one of claim 14 wherein at least one of the radial first and second slots is provided with a curved or hockey-stick shaped slot portion toward the wire axis.

16. The tool according to any one of claim 1 wherein each of the first and second portions are provided with a means of increasing friction with a user's hands when said portions are rotated by said hands.

17. The tool according to claim 16 wherein said means of increasing friction is selected from the class consisting of indents, protrusions, knurling, scorings and scalloped protrusions.

18. The tool according to any one of claim 1 wherein the spacer is formed by cold-pressing sheet metal.

19. The tool according to claim 1 wherein said levering element comprises a prong which is threaded.

20. The tool according to claim 1 wherein said levering element comprises a prong which is headed in the manner of a nail.

* * * * *